US010119438B2

(12) United States Patent
Sun et al.

(10) Patent No.: US 10,119,438 B2
(45) Date of Patent: Nov. 6, 2018

(54) POSITIVE CRANKCASE VENTILATION SYSTEMS AND ENGINE SYSTEMS INCLUDING THE SAME

(71) Applicant: Ford Global Technologies, LLC, Dearborn, MI (US)

(72) Inventors: Baocheng Sun, Beverly Hills, MI (US); Bruce Li, Nanjing (CN); Bin Yin, Nanjing (CN); Dallis Sun, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 92 days.

(21) Appl. No.: 15/494,375

(22) Filed: Apr. 21, 2017

(65) Prior Publication Data

US 2017/0314431 A1 Nov. 2, 2017

(30) Foreign Application Priority Data

Apr. 29, 2016 (CN) ..... 2016 1 0281171

(51) Int. Cl.

| | |
|---|---|
| ***F02B 47/00*** | (2006.01) |
| ***F01M 13/00*** | (2006.01) |
| ***F02D 41/00*** | (2006.01) |
| ***F02M 35/10*** | (2006.01) |

(52) U.S. Cl.

CPC ..... *F01M 13/0011* (2013.01); *F01M 13/00* (2013.01); *F02D 41/0025* (2013.01); *F02D 41/0087* (2013.01); *F02M 35/10222* (2013.01); *F01M 2013/0022* (2013.01); *F01M 2013/0038* (2013.01); *F02D 2250/08* (2013.01)

(58) Field of Classification Search

CPC ..... F01M 13/0011; F01M 2013/0022; F01M 2013/0038; F02D 2250/08; F02D 41/0025; F02D 41/0087; F02M 35/10222

USPC ..... 123/572–574, 41.86, 184.21, 184.22, 123/184.47, 184.53, 184.54

See application file for complete search history.

(56) References Cited

U.S. PATENT DOCUMENTS

| | | | | |
|---|---|---|---|---|
| 5,307,784 A * | 5/1994 | Choma | ..... | F02M 26/50 123/568.17 |
| 7,198,040 B2 * | 4/2007 | Noda | ..... | F02M 25/06 123/568.15 |
| 8,020,541 B2 * | 9/2011 | Nelander | ..... | F01M 13/021 123/184.21 |
| 9,027,536 B2 | 5/2015 | Pursifull et al. | | |

(Continued)

FOREIGN PATENT DOCUMENTS

KR 100345836 B1 * 7/2002

*Primary Examiner* — Grant Moubry
*Assistant Examiner* — Tea Holbrook
(74) *Attorney, Agent, or Firm* — Julia Voutyras; Mohr IP Law Solutions, PC

(57) ABSTRACT

An engine system comprises an intake manifold including a manifold body downstream of an intake port and having a first through-aperture and a second through-apertures spaced apart from the first through-aperture on the manifold body; a positive crankcase ventilation (PCV) system including a first PCV branch and a second PCV branch communicated fluidly with the first through-aperture and the second through-aperture of the manifold body, respectively, and configured to route a blow-by gas in a crankcase to the intake manifold; and a variable valve assembly to regulate a flow passing through the first or second PCV branches.

20 Claims, 6 Drawing Sheets

(56) References Cited

U.S. PATENT DOCUMENTS

| | | | | |
|---|---|---|---|---|
| 9,194,338 | B2 | 11/2015 | Lohr | |
| 9,217,343 | B2 | 12/2015 | Rice et al. | |
| 2004/0159299 | A1* | 8/2004 | Uchiyama | F02M 25/06 123/184.42 |
| 2004/0206343 | A1* | 10/2004 | Oota | F01M 13/022 123/572 |
| 2004/0261776 | A1* | 12/2004 | Knaus | F01M 13/022 123/572 |
| 2011/0315125 | A1* | 12/2011 | Lohr | F02M 35/10229 123/519 |
| 2014/0034031 | A1 | 2/2014 | Wagner | |
| 2014/0277996 | A1 | 9/2014 | Pierik et al. | |
| 2015/0159596 | A1 | 6/2015 | Wakiya | |
| 2017/0002776 | A1* | 1/2017 | Sun | F02M 35/10222 |

* cited by examiner

POSITIVE CRANKCASE VENTILATION SYSTEMS AND ENGINE SYSTEMS INCLUDING THE SAME

RELATED APPLICATION

This application claims the benefit of Chinese Patent Application No.: CN 201610281171.5 filed on Apr. 29, 2016, the entire contents thereof being incorporated herein by reference.

FIELD

The application relates to positive crankcase ventilation systems in an engine, in particulate, relates to the positive crankcase ventilation system that regulates a blow-by gas flow.

BACKGROUND

During operation of an internal combustion engine combustion, a small amount of unburned fuel-air mixture is leaked to a crankcase through a gap between a cylinder wall and a piston. The leaked fuel-air mixture is called blow-by gas of the engine. The gases in the crankcase include unburned fuel gas, steam, and exhaust gas. The current technologies use positive crankcase ventilation (PCV) to route the blow-by gas to an intake manifold of the engine to utilize the fuel efficiently, minimize the discharge of the air pollutants, and solve the issue of the engine oil degradation.

US2014/0326226A1 discloses a PCV device adjacent to an exhaust gas recirculation (EGR) pipe to heat the blow-by gas and includes a plural of pipes inside the intake manifold to route the engine blow-by gas into a plurality of runners of the intake manifold.

With the development of automobile technology, variable displacement engines (VDE) have been applied in the vehicles. During an engine operation, some cylinders may be stopped to enhance the engine's efficiency in certain operation loads (e.g., a low operation load). Cylinder deactivation may be achieved by closing the cylinder's intake valve and exhaust valve. During cylinder deactivation, however, the blow-by gas may still route to every intake manifold branch (e.g., the PCV device in US2014/0326226A1) as in a normal cylinder operation, which may result in a low efficiency of the blow-by gas utilization and fluctuation of the fuel/air ratio, causing unstable combustion that effects smooth power output from the engine.

SUMMARY

According to one aspect, an engine system comprises an intake manifold including a manifold body downstream of an intake port, and the manifold body includes a first through-aperture and a second through-apertures spaced apart from the first through-aperture. The engine system further includes a positive crankcase ventilation (PCV) system including a first PCV branch and a second PCV branch communicated fluidly with the first through-aperture and the second through-aperture of the manifold body, respectively, and configured to route a blow-by gas in a crankcase to the intake manifold. The engine system further includes a variable valve assembly to regulate a flow through the first PCV branches or the second PCV branch.

In one embodiment, the engine system further comprises an engine control unit (ECU) to control the variable valve assembly to regulate the flow in response to cylinder deactivation.

In another embodiment, the engine system further comprises a first runner, a second runner, a third runner and a fourth runner extending from the manifold body to a first cylinder, a second cylinder, a third cylinder and a fourth cylinder of the engine, respectively. The first, second, third and fourth cylinders are arranged in a sequence, and the first through-aperture is positioned between the first and second runners and the second through-aperture is positioned between the third and fourth runners. The variable valve assembly regulates a flow through the second through-aperture when the first and fourth cylinder are deactivated.

In another embodiment, the variable valve assembly is configured to reduce a blow-by gas flow to the second through-aperture when the first and fourth cylinders are deactivated.

In another embodiment, the variable valve assembly is configured to block a blow-by gas flow to enter the second PCV branch when the first and fourth cylinders are deactivated.

In another embodiment, the engine system further comprises a first runner, a second runner, and a third runner extending from the manifold body to a first cylinder, a second cylinder and a third cylinder of an engine, respectively. The first through-aperture is positioned between the first and second runners and the second through-aperture is positioned between the second and third runners. The variable valve assembly is configured to regulate a blow-by gas flow to one of the first and second through-apertures when at least one cylinder is deactivated.

In another embodiment, the engine system further comprises a PCV pipe connected with the crankcase and the first and second PCV branches, and the valve assembly is connected to the PCV pipe.

In another embodiment, the first and second PCV branches and the PCV pipe are formed as an integral piece, and wherein the valve assembly is positioned in the first PCV branch.

In another embodiment, the first and second PCV branches and the PCV pipe are formed as an integral piece, and the valve assembly is positioned at a junction of the first and second PCV branches.

In another embodiment, the variable valve assembly comprises a solenoid valve.

According to another aspect, a positive crankcase ventilation (PCV) system in an engine is provided. The engine includes a crankcase and an intake manifold. The PCV system comprises a PCV pipe coupled to the crankcase; and a first PCV branch and a second PCV branch extended from the PCV pipe and connected to a first through-aperture and a second through-aperture spaced apart from the first through-aperture on a manifold body of the intake manifold, respectively. The first and second PCV branches are configured to route a blow-by gas in the crankcase to the intake manifold. The PCV system further comprises a variable valve to regulate a blow-by gas flow through one of the first and second PCV branches in response to engine cylinder deactivation.

In one embodiment, the PCV system further comprises an engine control unit (ECU) to control the variable valve to block the blow-by gas flowing through in one of the first and second PCV branches when selected engine cylinders are deactivated.

According to another aspect, a method is provided to operate a PCV system in a variable displacement engine. The engine includes a positive crankcase ventilation (PCV) system to route a blow-by gas in a crankcase to an intake manifold of the engine. The method comprises routing the blow-by gas to the intake manifold via a first PCV branch and a second PCV branches of the PCV system; and adjusting a flowrate in one of the first PCV branch and the second PCV branch via a valve disposed in the PCV system in response to deactivation of selected cylinders.

In one embodiment, the flowrate in the first PCV and the second PCV branches is adjusted to maintain a predetermined air/fuel ratio in activated cylinders.

In another embodiment, the engine includes four cylinders and the valve is disposed in one of the first and second PCV branches, and adjusting the flow in the one of the first and second PCV branches includes closing the valve when two cylinders are deactivated.

In another embodiment, the cylinders are arranged with an in-line configuration.

In another embodiment, the valve is disposed upstream before a junction of the first and second PCV branches or the valve is a three-way valve disposed at the junction of the first and second PCV branches.

In another embodiment, the engine includes a first cylinder, a second cylinder, a third cylinder, and a fourth cylinder coupled to a first runner, a second runner, a third runner and a fourth runner in the intake manifold; respectively. The first PCV branch is positioned between the first and second runners and the second PCV branch is positioned between the third and fourth runners, and the valve is disposed in the first PCV branch or the second PCV branch.

In another embodiment, the valve is closed when the first and fourth cylinders are deactivated to maintain an air/fuel ratio in the second and third cylinders substantially the same as an air/fuel ratio before deactivation of the first and fourth cylinders.

In another embodiment, the valve is a solenoid valve.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

The disclosed positive crankcase ventilation (PCV) systems and methods to operate an engine assembly will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various PCV systems and methods to operate the engine assembly are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example ill be described in that particular example. The reader should understand that a given feature need not be the same or similar to the specific portrayal of a related feature in any given figure or example.

The positive crankcase ventilation (PCV) systems of the present disclosure are advantageous at least in the aspects of improving the blow-by gas recirculation in an engine with cylinder deactivation function or a variable displacement engine. In particular. a PCV system having branches can evenly route the blow-by gas to the intake manifold during a normal operation of all cylinders, and a valve in the PCV system stops or reduces the blow-by gas flowing to the PCV branch fluidly communicated with the deactivated cylinders so that the blow-by gas can be routed evenly to the cylinders still in activation during the operation of deactivation of selected cylinders.

Figure 1:
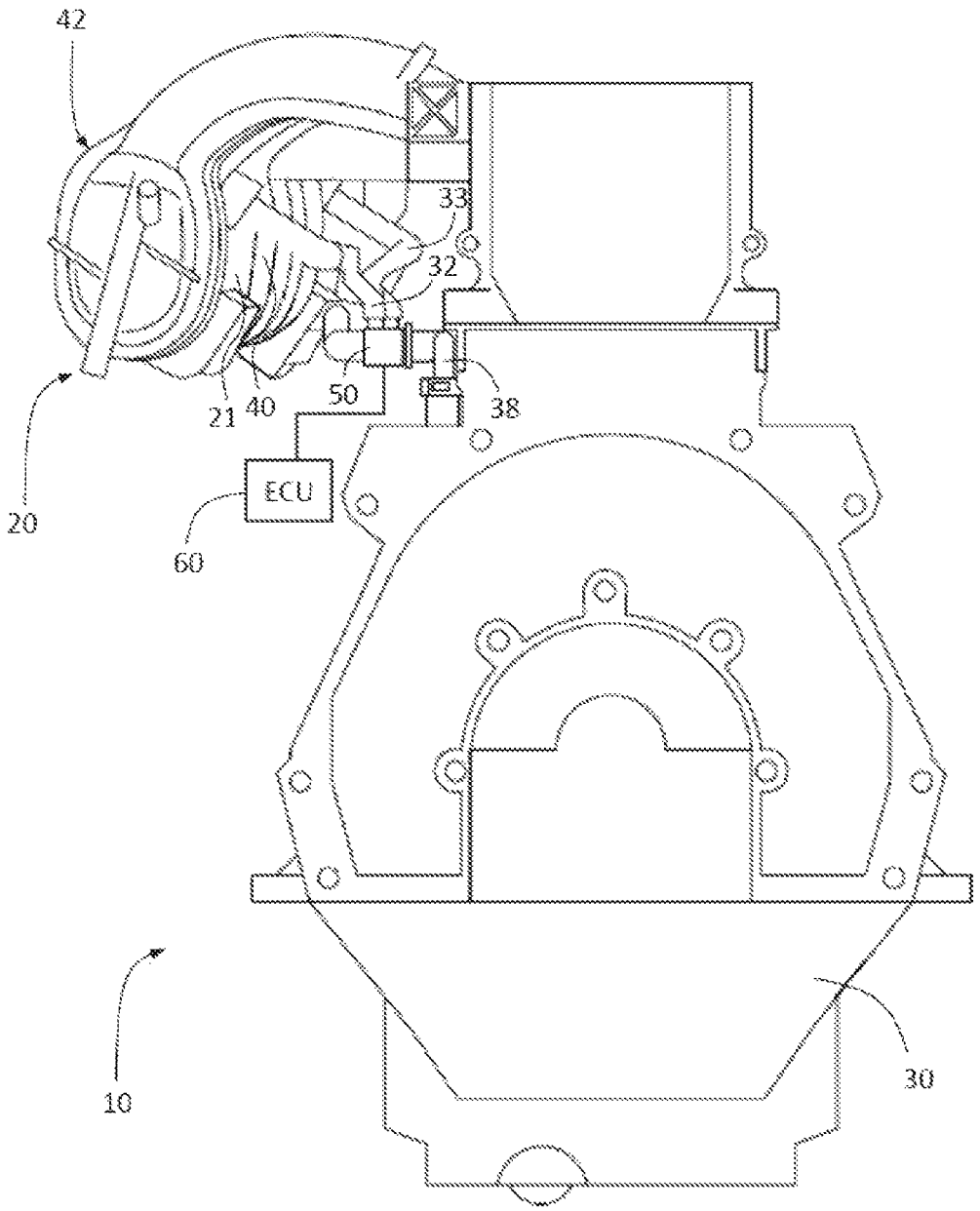
FIG. 1 schematically illustrates a perspective view of an engine assembly according to one embodiment of the present disclosure.
Figure 2:
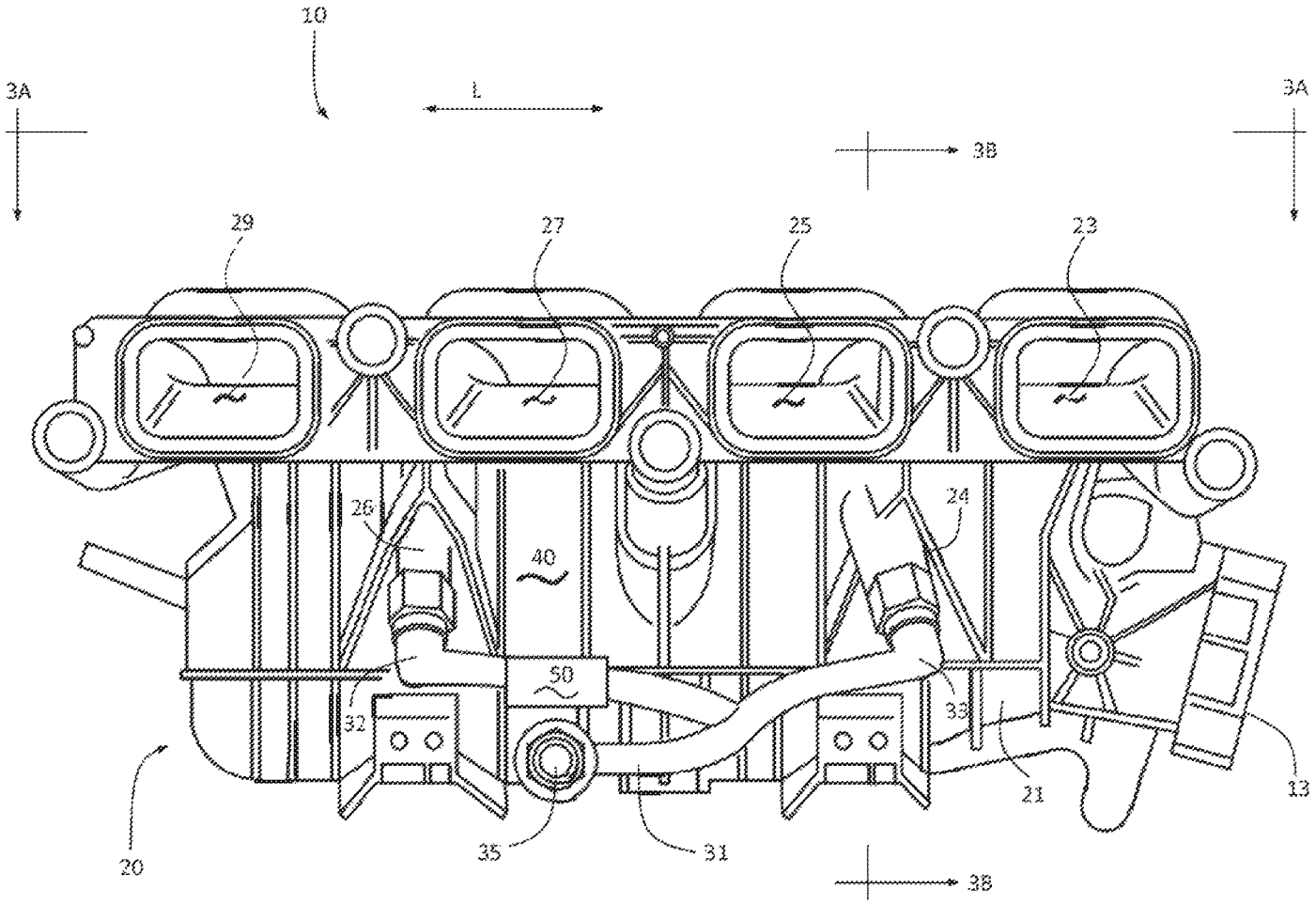
FIG. 2 is a front perspective view of an intake manifold of the engine in FIG. 1.

FIG. 1 schematically illustrates a perspective view of an engine assembly or an engine system 10 according to one embodiment of the present disclosure. FIG. 2 is a front perspective view of an intake manifold of the engine in FIG. 1. Referring FIGS. 1-2, the engine system 10 comprises an intake manifold 20 downstream of an intake port 13 and an intake manifold body 21. The intake manifold body 21 includes a first through-aperture 24 and a second through-apertures 26 spaced apart from the first through-aperture 24. The first through-aperture 24 and the second through-aperture 26 are formed on a wall of the intake manifold body 21 and fluidly communicated with a first PCV branch 32 and a second PCV branch 33, respectively.

The engine system 10 further includes a crankcase 30 and a PCV device 38 disposed on the crankcase 30. The PCV device 38 is configured to collect the blow-by gas in the crankcase 30, which may be integrated in the crankcase 30 or attached on a surface of a crankcase 30.

The PCV device 38 is connected to the engine intake manifold 20 via a PCV pipe 31 to route the blow-bay gas to the intake manifold 20 for mixing with fresh air from the intake port 13 and supplying the mixture gas to an engine combustion chamber for combustion. In one or more embodiments, the PCV pipe 31 may be fluidly connected with a first PCV branch 32 and a second PCV branch 33. In other words, a fluid entering PCV pipe 31 from the PCV device 38 is divided into two flows in two directions (i.e., two different directions) to enter the intake manifold body 21 via the first PCV branch 32 and second PCV branch 33.

The engine system 10 may be any suitable type of engines. In some embodiments, the engine may have an inline configuration, V-type, or other types, and may include 3 cylinders, 4 cylinders, or 6 cylinders. In some embodiments, as shown in FIG. 1 and with reference to FIG. 2 and FIG. 5, the engine system 10 is an inline-four-cylinder engine. The intake manifold 20 has an intake manifold body 21 with runners 23, 25, 27, and 29 extending from the intake manifold body 21 corresponding to the engine cylinders 1, 2, 3, and 4, respectively. The four cylinders 1, 2, 3 and 4 of the engine are arranged inline along a longitudinal axis of a cylinder cover. The intake manifold 20 has an intake port 13 connecting the intake pipe. Two through-apertures 24 and 26 are disposed on the intake manifold body or on the wall 40 of the intake manifold body 21. The through-aperture 24 is closer to the intake port 13 than the through-aperture 26 at the longitudinal direction L.

The through-aperture 24 may be positioned between the runners 23 and the runner 25 in the L direction, or between the runner 25 and runner 27. Similarly, the through-aperture 26 may be positioned between the runner 27 and the runner 29 in the L direction, or between the runner 25 and the runner 27. The through-apertures 24 and 26 are connected with the two branches 32, 33 of the PCV 31, respectively to provide a fluid communication.

In some embodiments, a third PCV branch (not show) may be added to connect the intake manifold body 21 with a third through-aperture for fluid communication when the first through-aperture 24 is disposed between the runners 23, 25, the second through-aperture 26 is disposed between the runners 27, 29 respectively, and the third through-aperture may be positioned on the wall 40 along with the direction L and between the runner 25 and the runner 27.

Another end 35 of the PCV pipe 31 is connected with the PCV device 38 to provide a fluid communication (referring to FIGS. 1 and 2) for routing the engine blow-by gas from the PCV device 38 into the intake manifold body 21 of the intake manifold 20.

The first PCV branch 32 and the second PCV branch 33 may be attached to the PCV pipe 31 at a position outside of the intake manifold body 1 or an external position. The attachment position may be at any position relevant to the wall 40 of the intake manifold body 21. Alternatively, the PCV pipe 31 may be an extension from the first PCV branch 32 or the second PCV branch 33. Alternatively, the PCV pipe 31, the first PCV branch 32 and the second PCV branch 33 may be formed integrally a single piece, such as formed from molding or an injection molding from one material or mixed material.

Figure 3A:
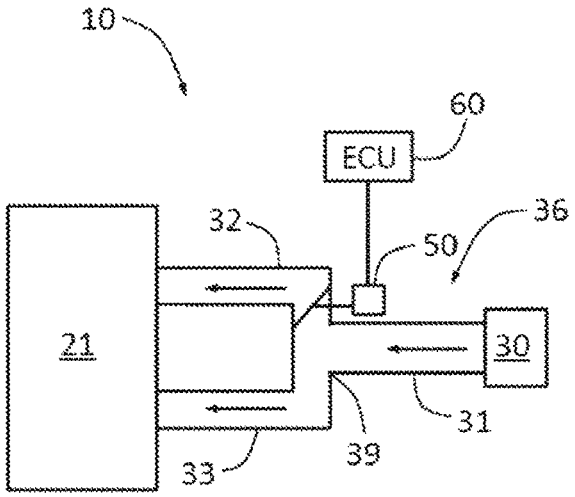
FIG. 3A is a schematic diagram illustrating the positions of the intake manifold and the positive crankcase ventilation branches of the engine assembly in FIG. 2 according to one embodiment of the present disclosure.
Figure 3B:
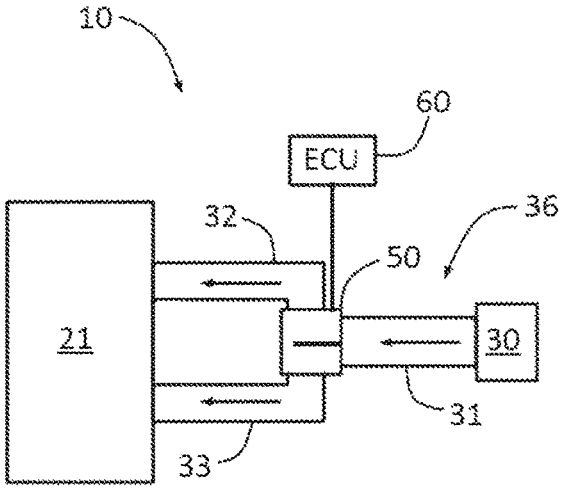
FIG. 3B is a schematic diagram illustrating position of the intake manifold and the positive crankcase ventilation branch of the engine assembly in FIG. 2 according to another embodiment of the present disclosure.

FIG. 3A is a schematic diagram illustrating the positions of intake manifold and positive crankcase ventilation branch of the engine system 10 in FIG. 2 according to one embodiment of the present disclosure. FIG. 3B is a schematic diagram illustrating the positions of intake manifold and positive crankcase ventilation branch of the engine system 10 in FIG. 2 according to another embodiment of the present disclosure. Referring to FIGS. 3A and 3B, a PCV pipe system 36 may be disposed between the intake manifold body 21 and the crankcase 30. The PCV pipe system 36 may include the PCV pipe 31, the first PCV branch 32 and the second PCV branch 33. The first PCV branch 32 and the second PCV branch are split from a junction 39. In one embodiment, a variable valve assembly 50 may be disposed on the first PCV branch 32 as shown in FIG. 3A or the second PCV branch 33. In another embodiment depicted in FIG. 3B, the variable valve assembly 50 may be disposed on the junction 39 of the first PCV branch 32 and the second PCV branch 33. The variable valve assembly 50 may dynamically regulate the gas flowrate in the first and second PCV branches 32, 33 of the PCV pipe 31 based on the engine cylinder deactivation state.

In other embodiments, the variable valve assembly 50 may be disposed at the connection position of the first PCV branch 32 and the first through-aperture 24 or the connection position of the second PCV branch 33 and the second through-aperture 26. The variable valve assembly 50 may include electric, hydraulic, pneumatic, mechanic, magmatic valve, and the motor that actuates the valves or other actuation devices. In a preferred embodiment, the variable valve assembly is a solenoid valve.

The variable valve assembly 50 may be controlled by an engine control unit (ECU) 60. For example, the degree of the opening or closing of the valve may be controlled by the ECU 60 to regulate or control the gas flowrate in the first PCV branch 32 and/or second PCV branch 33 in the PCV system 36 based on the engine operation condition such as the power output or deactivation of the selected cylinders.

In the inline four-cylinder engine configuration, four cylinders 1, 2, 3, and 4 are configured to have two groups, each having two cylinders. In one embodiment, two outer cylinders form the first group, and two inner cylinders form the second group. In another embodiment, when the engine operates with some cylinder deactivated, the cylinder 2 and 3 in second group are still in activation. Under this condition, the cylinders 1 and 4 may be configured to switch an operation state and be deactivated at a partial load condition by closing the intake valve and exhaust valve. Meanwhile, the cylinders 2 and 3 operate. Under a condition at which less power output is demanded, the engine operates with less activated cylinders at less fuel consumption rate, which will improve the engine efficiency.

The variable valve assembly 50 as a flow regulator may change the size of a cross section area of a flow of the blow-by gas in the PCV branches or the flowrate of the blow-by gas in the PCV branches, and thus achieving stable fuel/air ratio of gas in the cylinders 2 and 3.

The internal combustion engine may have at least of two cylinders or at least two cylinder groups, each containing at least one cylinder. Although FIG. 2 shows a four-cylinder engine, it should be appreciated that the PCV system may be used in an engine having three cylinder groups, each having one cylinder, or an engine having three cylinder groups, each having two cylinders, such as V6 or V8 engine. Under a condition where selected cylinders are deactivated, a three cylinder groups may be consecutively activated or deactivated to achieve different deactivation modes. Therefore, deactivation of selected cylinders may be optimized. Each group may include different numbers of cylinders.

Referring to FIGS. 1-2, the PCV device 38 may be connected with the PCV pipe 31 at one end 35, and another end of the PCV pipe 31 may have at least two of PCV branches 33 and 32 connecting with the through-apertures 24 and 26, respectively. Under the deactivation of selected cylinders such as deactivation of the cylinders 1 and 4 in the first group, the valves in the variable valve assembly 50 may be adjusted to distribute unevenly the blow-by gas into the PCV branches. For example, the variable valve assembly 50 may control the flow into the PCV branch 32 to be smaller than the flow in PCV branch 33.

In some embodiments, the variable valve assembly 50 may be adjusted to close the valve in the PVC branch 32 to stop the blow-by gas into the PVC branch 32 to allow the blow-by gas to enter the PVC branch 33 only. With reduced flow or even no flow of the blow-by gas entering the second through-aperture 26, the blow-by gas may be concentrated in the first through-aperture 24 adjacent to the intake port so that the flow rate or the velocity of the blow-by gas in the first through-aperture 24 adjacent to the intake port is increased. In this way, the blow-by gas is sufficiently mixed with the fresh air from the intake port in the area near the first through-aperture 24 before entering the runners corresponding to the cylinders 2 and 3 of the second group to minimize fluctuation of fuel/air ratio in branch corresponding to the cylinders 2 and 3 in the first group.

A variable valve assembly 50 disposed on the PCV pipe or branches can adjust the blow-by gas flow according to activation or deactivation of the cylinders. For example, the valve is opened at a full cylinder activation so that the blow-by gas can enter the different portions of the intake manifold 21 via the two through-apertures 24 and 26 to be mixed about simultaneously with the fresh air entering from the intake port 13, and thus avoiding fluctuation of the fuel/air ratio in the intake manifold and improve consistence of fuel/air ratio in the all branches. The valve may be turned off or partially turned off when selected cylinders are deactivated to distribute the blow-by gas in area of the activated cylinders, and thus preventing the blow-by gas spreading or mixing in an unnecessary area.

In one embodiment, the engine includes three inline cylinders and three runners are extended from the intake manifold corresponding to three cylinders arranged sequentially along with a longitudinal axis of the cylinder cover. The first runner, second runner, and third runner correspond to the first cylinder, second cylinder, and third cylinder, respectively. The intake manifold body may include one through-aperture aperture between the first runner and the second runner, and another through-aperture between the second runner and third runner. PCV system may include a PCV pipe connecting with the crankcase and two PCV branches. The two PCV branches are connected with the two through-apertures to provide a fluid communication. During an engine operation with selected cylinder deactivated, at least one of the cylinders such as the first cylinder may be deactivated. In one embodiment, the variable valve assembly connected on the PCV pipe 31 may regulate a flowrate on one of the two PCV branches to reduce or even fully shutoff the blow-by gas to the runner responding to the deactivated cylinder, and thus the blow-by gas may be routed to the intake manifold from another through-aperture to be sufficiently mixed with the fresh air before entering the runners corresponding to the second and third activated cylinders. In one embodiment, the variable valve assembly may be disposed on one of the PCV branches.

In some embodiments as shown in FIGS. 1 and 2, the through-apertures 24 and 26 may be disposed on the wall 40 of the intake manifold body 21 and facing the PCV device 38, in other words, openings of the through-apertures 24 and 26 may face the crankcase 30.

Figure 4:
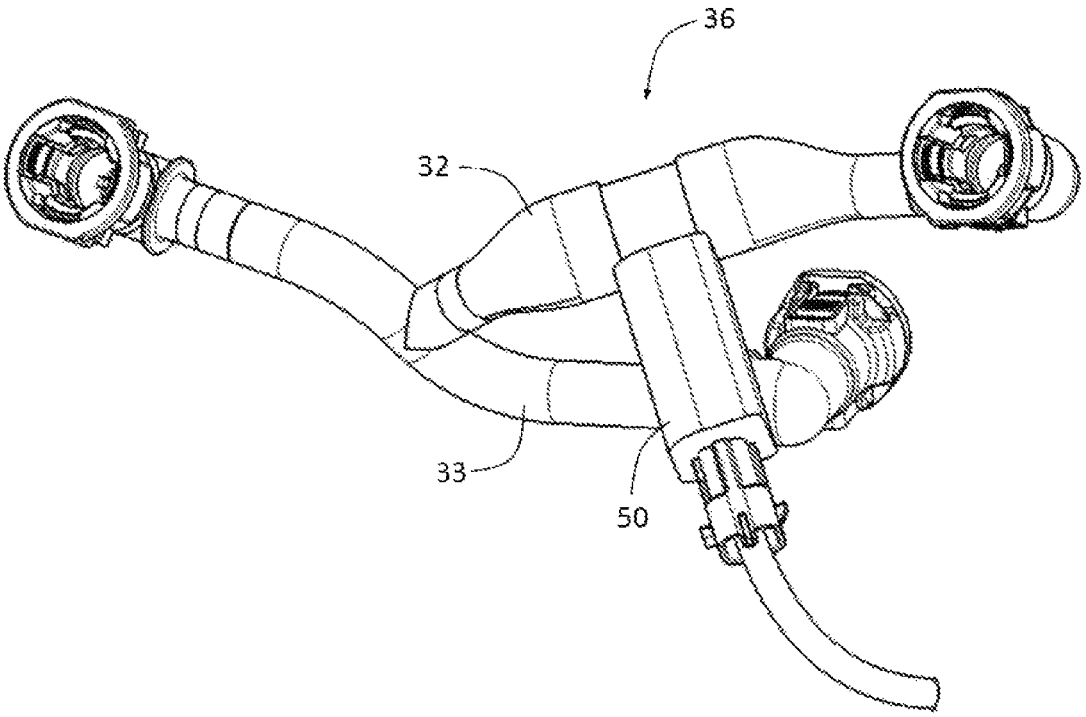
FIG. 4 schematically illustrate a PCV positive crankcase ventilation disposed on the engine assembly in FIG. 1.

FIG. 4 schematically illustrate a PCV system 36 including the variable valve assembly 50, which is disposed on the engine system in FIG. 1. The variable valve 50 as a flow regulator can adjust flowrate of the blow-by gas in the PCV pipe system 36. The PCV system 36 includes a first PCV branch 32 and a second PCV branch 33. In the embodiment depicted in the FIG. 4, the variable valve assembly 50 is disposed in the PCV branch 32 to regulate flowrate of the blow-by gas in the PCV branch 32. For example, the variable valve assembly 50 reduces or blocks a flow of the blow-by gas in the PCV branch 32.

Figure 5:
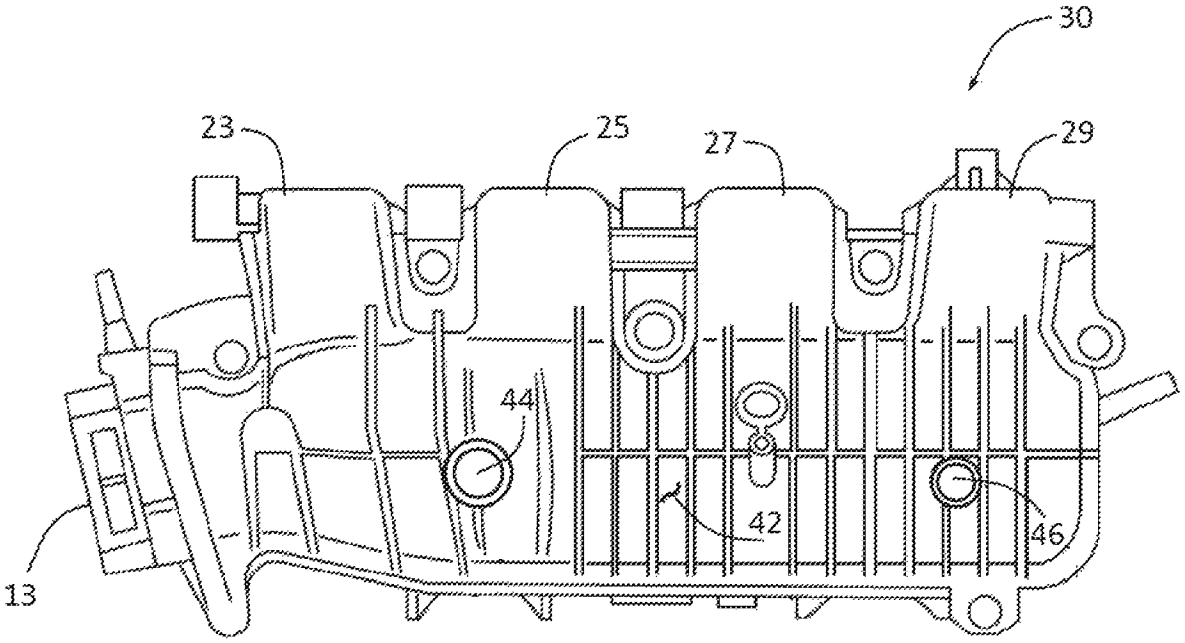
FIG. 5 is a rear view of an intake manifold of an engine assembly according to another embodiment of the present disclosure.

Referring to FIG. 5, in one or more embodiments, the engine system 30 may include two or more through-apertures 44, 46 on a wall 42 of the intake manifold body and the through-aperture 44, 46 are opposite to the PCV device 38. These through-apertures 44, 46 may be configured to be similar to the through-apertures 24, 26 to be connected with the first PCV branch 32 and the second PCV branch 33 which are joined with the main PCV pipe 31. Such configuration is advantageous where there is a limited space between the intake manifold 21 and the PCV device 38. Alternatively, a configuration may be adapted to have a through-aperture facing the PCV system and a through-aperture opposite the PCV system and corresponding PCV branches to effectively utilize the blow-by gas.

Figure 6:
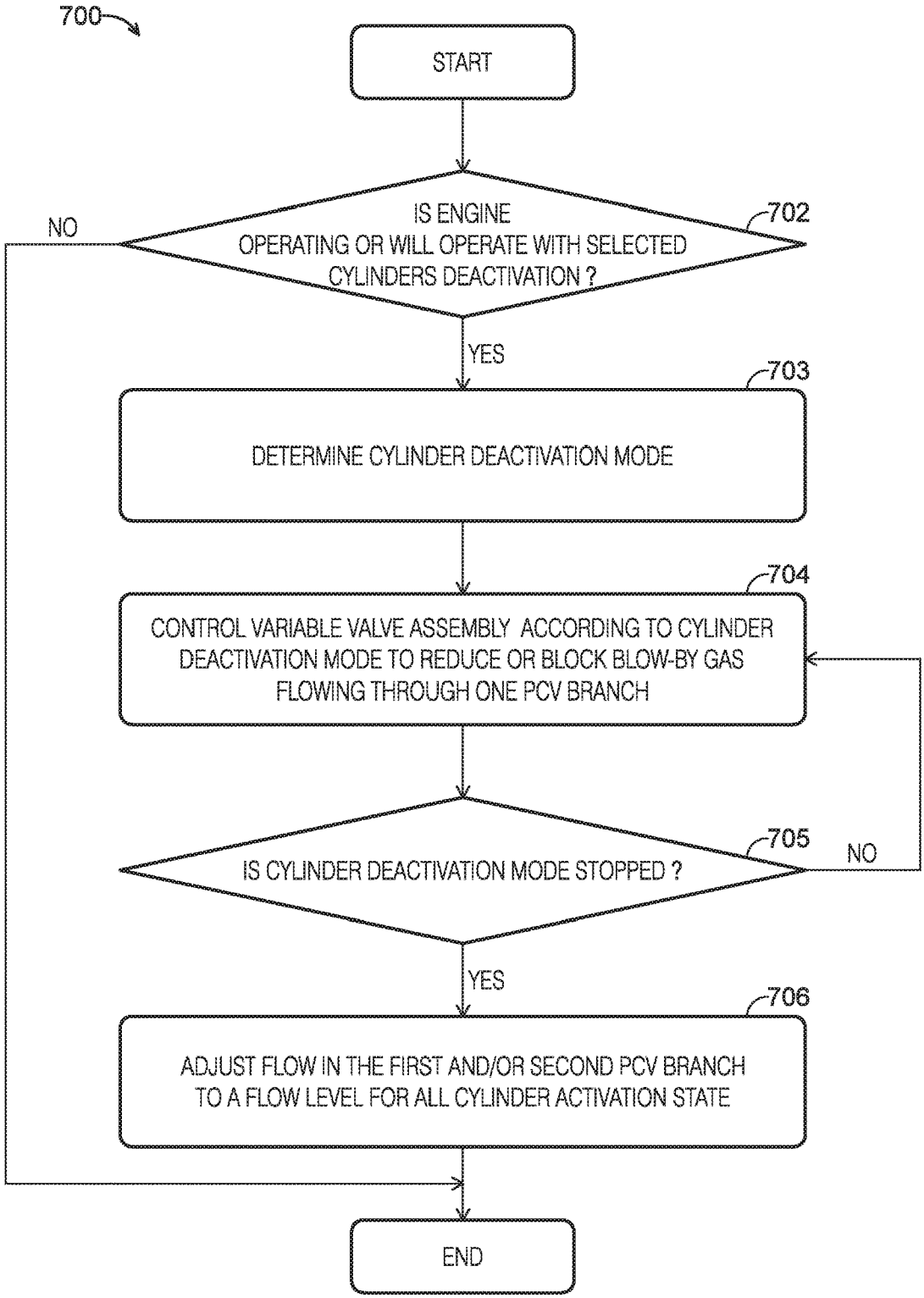
FIG. 6 is a flow chart to operate an engine assembly according to one embodiment of the present disclosure.

FIG. 6 shows an example method 700 to operate an engine according to one embodiment of the present disclosure. The method 700 or the routine 700 may be executed by an engine control unit 60 and stored in a memory unit. The method 700 may adjust and/or control a flowrate or flow distribution entering intake manifold from the PCV system. The blow-by gas in the crankcase may be routed to the intake manifold via the first PCV branch and the second PCV branch of the PCV system. The flowrate of the blow-by gas in the first PCV branch and the second. PCV branch may be controlled based on the engine cylinder deactivation state. At 702, the method 700 includes determining if the engine is operating or will be operating with selected cylinder deactivation. In one or more embodiments, whether the engine is operating or will operate with selected cylinder deactivation may be determined according to an engine load. In one or more embodiments, whether or not stopping the cylinder deactivation is determined by a driver demand (e.g., a position of an accelerator or a throttle position). If the method 700 determines the engine is operating at or will operate with selected cylinder deactivation, the method 700 goes to step 703. Otherwise, the method 700 stops.

At 703, the method 700 includes determining a cylinder deactivation mode, that is, determining a cylinder or a group of cylinder that is deactivated. In a four-cylinder engine, for example, the method 700 may determine whether cylinder 1 and 4 are in the cylinder deactivation state or cylinder 2 and 3 are in the deactivation state.

At 704, the method 700 includes controlling the variable valve assembly in the PVC pipe or branches 50 according to the cylinder deactivation mode to reduce or block the blow-by gas flowing through one PCV branch. For example, the engine control unit 60 can issue instructions to the variable valve assembly 50 and the variable valve assembly 50 adjusts the position of the valve according to the instructions to regulate the flowrate of the blow-by gas entering the intake manifold of the engine.

In some embodiments, the variable valve assembly 50 adjusts a flowrate of blow-by gas in a PCV branch 32 of the PCV system 36, which may decrease the flowrate or completely stop the blow-by gas flowing through the PCV branch 32. In other embodiments, the variable valve assembly 50 can adjust a flowrate in the PCV branches 32 and 33 in the PCV system, respectively so that the flowrate in the PCV branch 32 and the PCV branch 33 are different.

The variable valve assembly 50 is controlled by the engine control unit 60 to adjust the flow rate in at least one of the two PCV branches 32 and 33 of the PCV system during deactivation of one cylinder group, and thus ensuring substantially consistent fuel/air ratio in the intake manifold for the second group of cylinder still in activated state.

In one embodiment, a standard value of the fuel/air ratio may be set (e.g., 14.6%). To achieve a stable combustion in an engine without a significant vibration, a variation of the fuel/air ratio in the intake manifold should be maintained within a range of the standard value, such as +/−0.5%. During the engine idle, fluctuation of the fuel/air ratio in the engine combustion chamber should not be over +/−0.25% of the standard value. In one or more embodiments, the variation of the fuel/air ratio in the runners of the second group of activated cylinders after the deactivation of the first cylinder group may be maintained to be substantially consistent with the variation before the deactivation of the first cylinder group. In one or more embodiments, the variation of the fuel/air ratio in the runners of the second group of activated cylinder after the deactivation of the first cylinder group may be maintained in a range of +/−0.25 of the fuel/air ratio before the deactivation of the first cylinder group.

At 705, the method 700 includes determining if the cylinder deactivation mode stops. When the vehicle demands more toque output, all the cylinders in the engine need to operate. Therefore, the engine control unit cancels the cylinder deactivation mode and control all cylinders in the activated state. In one or more embodiments, whether to stop the cylinder deactivation mode may be determined according to the demand from the driver (e.g., a position of the accelerator or an engine throttle position).

If the answer is no at 705, the method returns to 704.

If the answer is yes, the method continues to 706. At 706, the method 700 includes adjusting the flowrate in the first and second PCV branches to a flow level for all cylinder activation state. The variable valve assembly 50 may adjust the blow-by gas rate in the first PCV branch and/or second PCV branch. In one or more embodiments, the method 700 includes increasing a flowrate in the first PCV branch and/or the second PCV branch. In one or more embodiments, the method 700 includes opening the valve for the blow-by gas to flow in the PCV branch that is closed during cylinder deactivation. As such, flowrate of the blow-by gas in the PCV branches is adjusted to the level of all cylinder activation state.

In some embodiments, the PCV system including the PCV branches enables the even distribution of the blow-by in the intake manifold in all cylinder activation operation. In the selected cylinder deactivation operation, the blow-by gas can be distributed evenly to the runners of the activated cylinders by decreasing or blocking the flow in the PCV branches corresponding to the deactivated cylinders via the valve assembly so that the blow-by gas is evenly supplied to the activated cylinders. The PCV system is simple and cost effective in manufacturing.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into computer readable storage medium in the engine control system.

It will be appreciated that the configurations and routines disclosed herein are exemplary in nature, and that these specific embodiments are not to be considered in a limiting sense, because numerous variations are possible.

The following claims particularly point out certain combinations and subcombinations regarded as novel and non-obvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

The invention claimed is:

1. An engine system, comprising:

an intake manifold including a manifold body downstream of an intake port, wherein the manifold body includes a first through-aperture and a second through-aperture spaced apart from the first through-aperture;

a positive crankcase ventilation (PCV) system including a first PCV branch and a second PCV branch communicated fluidly with the first through-aperture and the second through-aperture of the manifold body, respectively, and configured to route a blow-by gas in a crankcase to the intake manifold; and a variable valve assembly to regulate a flown passing through the first PCV branch or a second PCV branch.

2. The engine system of claim 1, further comprising an engine control unit (ECU) to control the variable valve assembly to regulate the flow in response to cylinder deactivation.

3. The engine system of claim 2, further comprising a first runner, a second runner, a third runner and a fourth runner extending from the manifold body to a first cylinder, a second cylinder, a third cylinder and a fourth cylinder of the engine, respectively, wherein the first through-aperture is positioned between the first and second runners and the second through-aperture is positioned between the third and fourth runners, and wherein the variable valve assembly regulates a flow through the second through-aperture when the first and fourth cylinder are deactivated.

4. The engine system of claim 3, where in the variable valve assembly is configured to reduce a blow-by gas flow to the second through-aperture when the first and fourth cylinders are deactivated.

5. The engine system of claim 3, wherein the variable valve assembly is configured to block a blow-by gas to flow through the second PCV branch when the first and fourth cylinders are deactivated.

6. The engine system of claim 1, further comprising a first runner, a second runner, and a third runner extending from the manifold body to a first cylinder, a second cylinder and a third cylinder of an engine, respectively, wherein the first through-aperture is positioned between the first and second runners and the second through-aperture is positioned between the second and third runners, and wherein the variable valve assembly is configured to regulate a blow-by gas flow in one of the first and second through-apertures when at least one cylinder is deactivated.

7. The engine system of claim 1, further comprising a PCV pipe connected with the crankcase and the first and second PCV branches, wherein the valve assembly is connected to the PCV pipe.

8. The engine system of claim 7, wherein the first and second PCV branches and the PCV pipe are formed as an integral piece, and wherein the valve assembly is positioned in the first PCV branch.

9. The engine system of claim 7, wherein the first and second PCV branches and the PCV pipe are formed as an integral piece, and wherein the valve assembly is positioned at a junction of the first and second PCV branches.

10. The engine system of claim 1, wherein the variable valve assembly comprises a solenoid valve.

11. A positive crankcase ventilation (PCV) system in an engine, the engine includes a crankcase and an intake manifold, the positive crankcase ventilation system comprising:

a PCV pipe coupled to the crankcase;

a first PCV branch and a second PCV branch extended from the PCV pipe and to be connected to a first through-aperture and a second through-aperture, respectively, wherein the first and second through-aperture are positioned on an intake manifold body of the engine and spaced apart each other, and wherein the first and second PCV branches are configured to route a blow-by gas in the crankcase to the intake manifold; and a variable valve to regulate a blow-by gas flowing through one of the first and second PCV branches in response to an engine cylinder deactivation.

12. The positive crankcase ventilation system of claim 11, further comprising an engine control unit (ECU) to control the variable valve to block the blow-by gas to one of the first and second PCV branches when selected engine cylinders are deactivated.

13. A method for operating a variable displacement engine, the engine including a positive crankcase ventilation system to route a blow-by gas in a crankcase to an intake manifold of the engine, the method comprising:

routing the blow-by gas to the intake manifold via one of a first PCV branch and a second PCV branches of the PCV system; and adjusting a flowrate in one of the first PCV branch and the second PCV branch via a valve disposed in the PCV system in response to deactivation of selected cylinders.

14. The method of claim 13, wherein the flowrate in the first PCV and the second PCV branches is adjusted to maintain a predetermined air/fuel ratio in activated cylinders.

15. The method of claim 13, wherein the engine includes four cylinders and the valve is disposed in one of the first and second PCV branches, and wherein adjusting the flow in the one of the first and second PCV branches includes closing the valve when two cylinders are deactivated.

16. The method of claim 15, wherein the cylinders are arranged with an in-line configuration.

17. The method of claim 16, wherein the engine includes a first cylinder, a second cylinder, a third cylinder, and a fourth cylinder coupled to a first runner, a second runner, a third runner and a fourth runner on the intake manifold, respectively, wherein the first PCV branch is positioned between the first and second runners and the second PCV branch is positioned between the third and fourth runners, and wherein the valve is disposed in the first PCV branch or the second PCV branch.

18. The method of claim 17, wherein the valve is closed when the first and fourth cylinders are deactivated to maintain an air/fuel ratio in the second and third cylinders substantially the same as an air/fuel ratio before deactivation of the first and fourth cylinders.

19. The method of claim 13, wherein the valve is disposed upstream before a junction of the first and second PCV branches or the valve is a three-way valve disposed at the junction of the first and second PCV branches.

20. The method of claim 13, wherein the valve is a solenoid valve.

* * * * *